US011473248B2

(12) United States Patent
Smart

(10) Patent No.: US 11,473,248 B2
(45) Date of Patent: Oct. 18, 2022

(54) MODULAR WALKWAY SYSTEM

(71) Applicant: Multy Home Limited Partnership, Concord (CA)

(72) Inventor: Dylan Smart, Langham (CA)

(73) Assignee: MULTY HOME LP, Concord (CA)

( * ) Notice: Subject to any disclaimer, the term of this patent is extended or adjusted under 35 U.S.C. 154(b) by 0 days.

(21) Appl. No.: 16/431,719

(22) Filed: Jun. 4, 2019

(65) Prior Publication Data

US 2019/0368134 A1 Dec. 5, 2019

(30) Foreign Application Priority Data

Jun. 5, 2018 (CA) ..... CA 3007232

(51) Int. Cl.

| | |
|---|---|
| ***E01C 5/00*** | (2006.01) |
| ***E01C 19/52*** | (2006.01) |
| ***E01C 5/22*** | (2006.01) |
| ***E01C 5/14*** | (2006.01) |

(52) U.S. Cl.
CPC ..... *E01C 5/001* (2013.01); *E01C 5/14* (2013.01); *E01C 5/223* (2013.01); *E01C 19/52* (2013.01)

(58) Field of Classification Search
CPC . E01C 5/001; E01C 5/14; E01C 5/223; E01C 19/52
USPC ..... 404/46, 17–36, 72–75; 52/177, 386, 387
See application file for complete search history.

(56) References Cited

U.S. PATENT DOCUMENTS 482,536 A * 9/1892 Zagelmeyer ..... E01C 15/226 404/46
1,465,033 A * 8/1923 William ..... E01C 5/18 404/32
1,970,037 A * 8/1934 Fischer ..... E01C 5/226 52/575
2,497,837 A * 2/1950 Nelson ..... E04F 15/02166 52/181
4,600,337 A * 7/1986 Sarver ..... E01C 5/14 404/35
1,875,800 A 10/1989 Hicks
4,875,800 A * 10/1989 Hicks ..... E01C 5/14 404/35

(Continued)

FOREIGN PATENT DOCUMENTS

CN 105887624 A 8/2016
DE 10108033 C1 * 2/2001 ..... E01C 9/08

(Continued)

OTHER PUBLICATIONS

Extended Search Report, EP 19815561.6, dated Mar. 25, 2022 (7 pp.).

*Primary Examiner* — Raymond W Addie

(74) *Attorney, Agent, or Firm* — Eversheds Sutherland (US) LLP

(57) ABSTRACT

A series of modules serve to provide a base for walkway members to be assembled into a walkway. Modules provide for support and orientation of walkway members and the ability to produce complex walkways with segments at varying orientations. In a preferred embodiment, a base mat is sized to engage walkway members. Using a combination of a number of base mats and walkway members, segments of walkway of any desired size can be readily assembled. Reflective and non-slip surfaces can be applied to increase safety when in use.

24 Claims, 9 Drawing Sheets

(56) References Cited

U.S. PATENT DOCUMENTS

| | | | | | |
|---|---|---|---|---|---|
| 4,973,193 | A * | 11/1990 | Watson | E01C 9/086 | 404/35 |
| 5,032,037 | A * | 7/1991 | Phillips | E01C 9/086 | 404/35 |
| 5,201,601 | A * | 4/1993 | Stanley | E01C 5/14 | 404/35 |
| 5,273,373 | A * | 12/1993 | Pouyer | E01C 9/086 | 404/35 |
| 5,761,867 | A * | 6/1998 | Carling | E01C 13/045 | 52/177 |
| 5,822,944 | A * | 10/1998 | Penland, Sr. | E01C 9/086 | 52/591.1 |
| 6,286,272 | B1 * | 9/2001 | Sandoz | E04F 13/10 | 404/46 |
| 6,339,908 | B1 * | 1/2002 | Chuang | E04F 15/04 | 52/177 |
| 6,874,972 | B2 * | 4/2005 | Davis | E01C 9/086 | 238/14 |
| 7,086,205 | B2 * | 8/2006 | Pervan | E04F 15/02 | 404/41 |
| 7,617,647 | B2 * | 11/2009 | Turner | E04F 15/02183 | 52/385 |
| 8,066,447 | B2 * | 11/2011 | Brandstrom | B27M 3/008 | 144/353 |
| 8,146,303 | B2 | 4/2012 | Gibson et al. | | |
| 8,382,393 | B1 * | 2/2013 | Phillips | E01C 9/086 | 404/35 |
| 8,616,804 | B2 * | 12/2013 | Corser | E01C 9/086 | 404/34 |
| 8,784,001 | B1 * | 7/2014 | Phillips | E21B 41/0021 | 404/35 |
| 8,973,326 | B2 | 2/2015 | Lenochi | | |
| 9,038,341 | B2 | 5/2015 | Lam et al. | | |
| 9,194,085 | B2 * | 11/2015 | Smith | E01C 5/18 | |
| 2011/0052318 | A1 * | 3/2011 | Smith | E01C 5/00 | 404/73 |
| 2015/0197899 | A1 | 7/2015 | Welch | | |
| 2016/0115653 | A1 * | 4/2016 | Forbes | E01C 5/14 | 404/35 |
| 2016/0177516 | A1 * | 6/2016 | Penland, Jr. | E01C 9/086 | 404/35 |

FOREIGN PATENT DOCUMENTS

| | | | |
|---|---|---|---|
| EP | 0869219 | A2 | 10/1998 |
| GB | 2 481 441 | A | 12/2011 |
| KR | 20060021069 | A | 3/2006 |
| KR | 101 038 704 | B1 | 6/2011 |
| WO | 2005040523 | A1 | 5/2005 |
| WO | 2010/079462 | A1 | 7/2010 |

* cited by examiner

MODULAR WALKWAY SYSTEM

This invention is in the field of temporary construction and safety equipment and more specifically deals with a means of providing temporary walkways on unprepared construction and landscape services.

BACKGROUND

In construction projects, it is common to have unprepared surfaces over which movement of workers and equipment can be difficult and potentially dangerous. For example, when working around a construction site at ground level, the surrounding ground may be uneven, or subject to moisture from either the weather or ongoing operations such that it would present a muddy surface that might be too soft for equipment to be moved, or dangerous for workers to walk on. Thus, it is often desirable to have prepared walkways over which workers can move from location to location at a worksite, and to provide an even surface over which to move equipment.

A variety of prior art walkway systems have been developed. However, they typically suffer from one or more limitations, including ease of assembly, cost of components, and adaptability to varying conditions at the work site. The present invention provides a novel walkway system that addresses limitations in the prior art.

SUMMARY OF THE INVENTION

The present disclosure describes embodiments of modular systems for assembling walkways and/or platforms for construction site use and other purposes. In one embodiment, a collection of modules can be used to provide a base on which to assemble a series of walkway members, and to provide means to create complex walkway patterns if desired, included junctions of walkway segments at various angles.

In one embodiment there is disclosed a base mat for use in a modular walkway, said base mat comprising a mat with an upward facing walkway surface and a downward facing ground surface and having a plurality of substantially parallel ribs extending outwards from the ground surface, each rib separated from each adjacent rib by a space sized to engage a walkway member which can extend through linear aligned spaces between ribs on adjacent base mats to align and hold in position a modular walkway, and wherein the linear orientation of the ribs will define a walkway orientation of the walkway surface.

The number of ribs on the ground surface of the base mat could be at least two, defining at least one space configured to engage a walkway member.

The base mat could also include a reflective material affixed to the base mat.

In a further embodiment, there is provided a modular system for assembling a walkway surface, the system comprising: a plurality of base mats and a plurality of walkway members, wherein each base mat comprises a main body with an upward facing walkway surface and a downward facing ground surface and having a plurality of substantially parallel ribs extending outwards from the ground surface, each rib separated from each adjacent rib by a space sized to engage a walkway member which can extend through linear aligned spaces between ribs on adjacent base mats to align and hold in position a modular walkway. The base mats are attachable adjacent to each other via the walkway members being placed between the ribs through linear aligned rib-defined spaces on the ground surface of adjacent base mats In some embodiments the system further comprises a plurality of fasteners, wherein each of the plurality of fasteners is configured to secure a walkway member to a base mat.

In some embodiments, walkway members are comprised of at least one of wood and composite material.

In some embodiments, each base mat comprises at least two ribs, and at least one space configured to engage a walkway member.

In some embodiments, the system further comprises a reflective material affixed to at least one base mat. In some embodiments, the system further comprises a non-slip material applied to at least one walkway member.

The present disclosure also provides a method of assembling a walkway using a modular system, the method comprising: providing a plurality of base mats and a plurality of walkway members, wherein each base mat comprises a main body, wherein the main body further comprises a plurality of ribs, each rib oriented substantially parallel to adjacent ribs and separated from each adjacent rib by a space, wherein the space between adjacent ribs is sized to engage at least one walkway member; and wherein the relative orientation of the ribs will define an orientation of the walkway surface; in a first assembly step, placing an end of a walkway member in the space between adjacent ribs of a first base mat; in a second assembly step, placing an opposite end of the walkway member in the space between two adjacent ribs of a second base mat; in a third assembly step, securing the walkway member to each of the first and second base mats; and repeating first, second and third assembly steps until each space in the first and second base mats is occupied by an end of a walkway member.

In some embodiments the method further comprises adding additional base mats and walkway members in such a way as to extend the walkway to a desired final length.

In some embodiments the method further comprises forming a junction in a walkway system by placing a first section of walkway and second section of walkway at an angle relative to each other. In some embodiments the angle is about 90°. In some embodiments the angle is between about 30° and 60°. In some embodiments the angle is about 45°.

In some embodiments of the method, the step of securing involves the use of at least one fastener.

In some embodiments the method further comprises providing walkway members comprising at least one of wood and a composite material. In some embodiments the method further comprises applying a non-slip material to at least one walkway member. In some embodiments the method further comprises affixing a reflective material to at least one of the base mats.

BRIEF DESCRIPTION OF THE DRAWINGS

Preferred embodiments of the present invention are described herein, with reference to the accompanying drawings, in which.

DESCRIPTION OF ILLUSTRATED EMBODIMENTS

Figure 1:
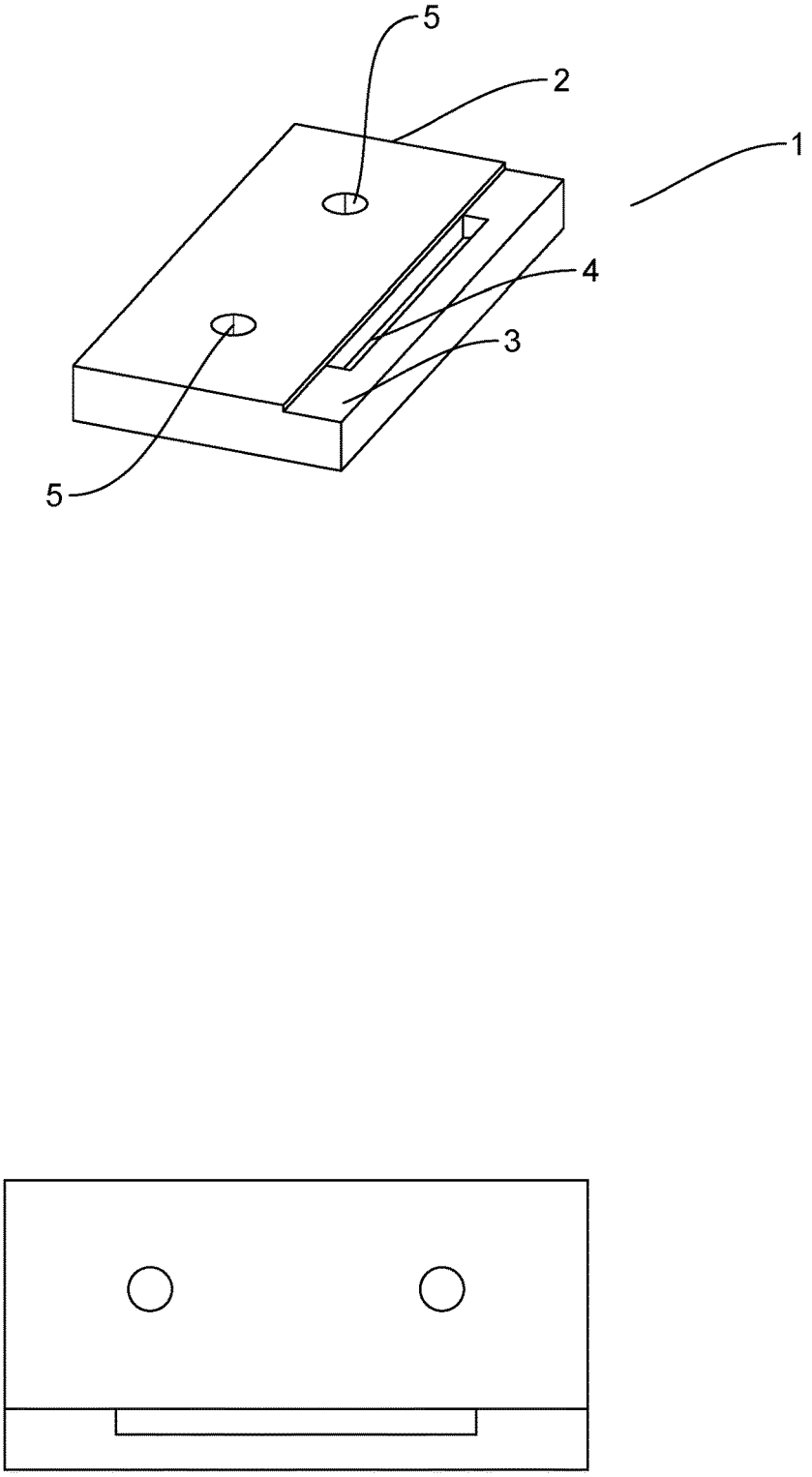
FIG. 1 depicts a perspective view of an embodiment of a base mat according to the present disclosure.

As described herein, and shown in the accompanying figures, the walkway system comprises several modular units that can be assembled in any number of configurations to form a temporary walkway. In one embodiment of the system, FIGS. 1 through 6 inclusive show embodiments of components with which to construct a walkway. As shown in FIG. 1, the walkway system first comprises a base mat 1 comprising a body structure with a main section 2 and slot section 3. The main section will generally comprise one or more holes 5 through which an anchor can be placed into the underlying ground surface upon which the walkway is being assembled. Anchors may be comprised of sharpened spikes or similar structures that can be driven into the ground, and then removed when it comes time to disassemble the walkway. The precise nature of the anchoring system is not limiting to the scope of the invention.

The slot section will comprise a slot 4, configured to receive a similarly sized and shaped tab that exists on other components of the system, as will become apparent. As shown in FIG. 1, the slot can be generally rectangular, although any shape slot may be formed in the base mat, so long as the slot is complimentary to the size and shape of the various tabs on other components that will be connected to the base mat in the assembly of a walkway.

Figure 2:
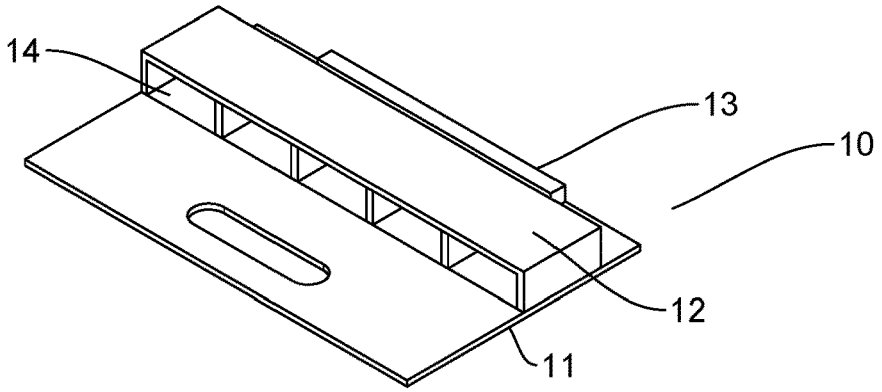
FIG. 2 depicts a perspective view of an embodiment of a base mat according to the present disclosure.
Figure 2:
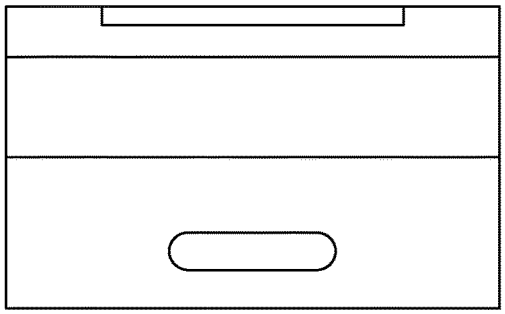

Continuing with the remaining components, there is also provided a base mat 10, being used as the key component in assembling the materials that will eventually comprise most of the walkway path. Each base mat comprises a body section 11, upon which is mounted a receiving section 12 and a tab 13. As depicted in FIG. 2, the receiving section is generally mounted in the middle of the body section. The receiving section is configured with one or more openings 14 into which the material being used to form the bulk of the walkway will be inserted. For example, and as shown in FIG. 2, the receiving section contains a plurality of openings that can be sized to receive a walkway member 51, which is some cases can comprise a standard piece of lumber such as a 2×4. By assembling several pieces of lumber together, and then placing a base mat over adjacent ends of said pieces of lumber, the lumber can be secured into place within the receiving section to effectively form a type of plank, upon which workers can walk and equipment can be moved. In the example shown in FIG. 2, the walkway would be five pieces of lumber wide.

It will be appreciated by those of skill in the art, that the number of pieces of lumber used to assemble a walkway section is not limiting, and that any number of pieces of lumber might be assembled to provide narrower or wider sections of walkway. For example, the base mat might be configured to receive a plurality of 2×4's, 2×6's, or 2×12's, to provide walkways of differing widths. The length of each walkway section will be dictated by the choice of length of lumber (or whatever material is used to form the walkway path) used. For example, a standard length for 2×4 lumber is 8'. Thus, by using pre-cut lumber, a user can readily assembly walkway sections that are nominally 8' long. The dimensions of the walkway members 51, are not limiting to the scope of the invention.

Just as a base mat was used to receive the ends of a number of pieces of lumber, at the opposite end, a second base mat will be used to organize the other ends of the lumber in the same manner. Thus, in one embodiment, a section of walkway comprises a series of piece of lumber (or other material) of similar length, assembled between two base mats, one placed at each end. The tab located on a base mat can be inserted into the slot on a base mat, or another one of the modular components as will become apparent.

Figure 3:
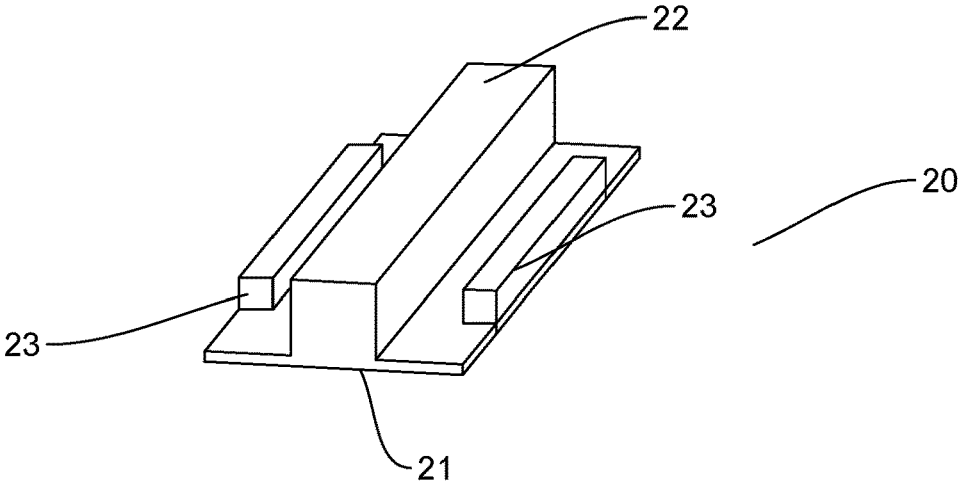
FIG. 3 depicts a perspective view of an embodiment of a connector block according to the present disclosure.
Figure 3:
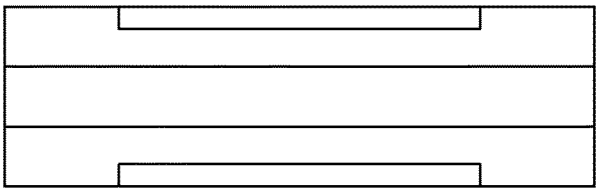

It will typically be the case that several sections of walkway will be required. Since the length of each section of walkways formed between 2 base mats will be limited by the length of the material used to form the walkway (8' as described in the exemplary embodiment), it will be necessary to assemble multiple sections of walkway to provide the needed length. Conveniently, there is also provided a connector block 20, configured to connect two base mats to each other to extend the length of a walkway by allowing sections of walkway to be connected in series to each other. As shown in FIG. 3, a connector block can comprise a body section 21, upon which are formed a central raised section 22. On either side of the central raised section are tabs 23. To connect two sections of walkway together, two walkway section ends will be brought together. As will be noticed from FIG. 2, the base mats have upward facing tabs 13. A connector block can be placed between two walkway sections with the central raised section and tabs oriented downwards relative to the upper surface of the walkway. The tabs on the base mats and connector blocks will engage each other such that the two sections of walkways are maintained connected with each other. This process can be repeated to form any length of walkway that may be required.

Figure 4:
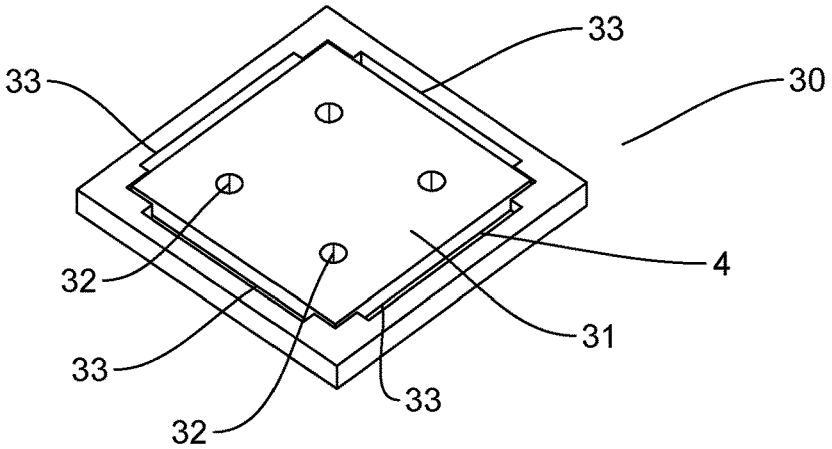
FIG. 4 depicts a perspective view of an embodiment of a main block according to the present disclosure.
Figure 4:
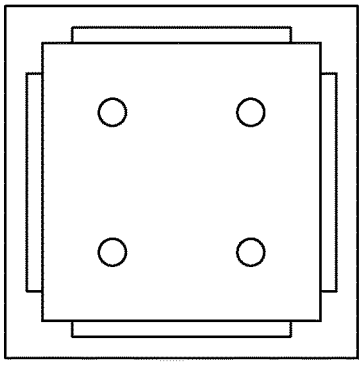
Figure 6:
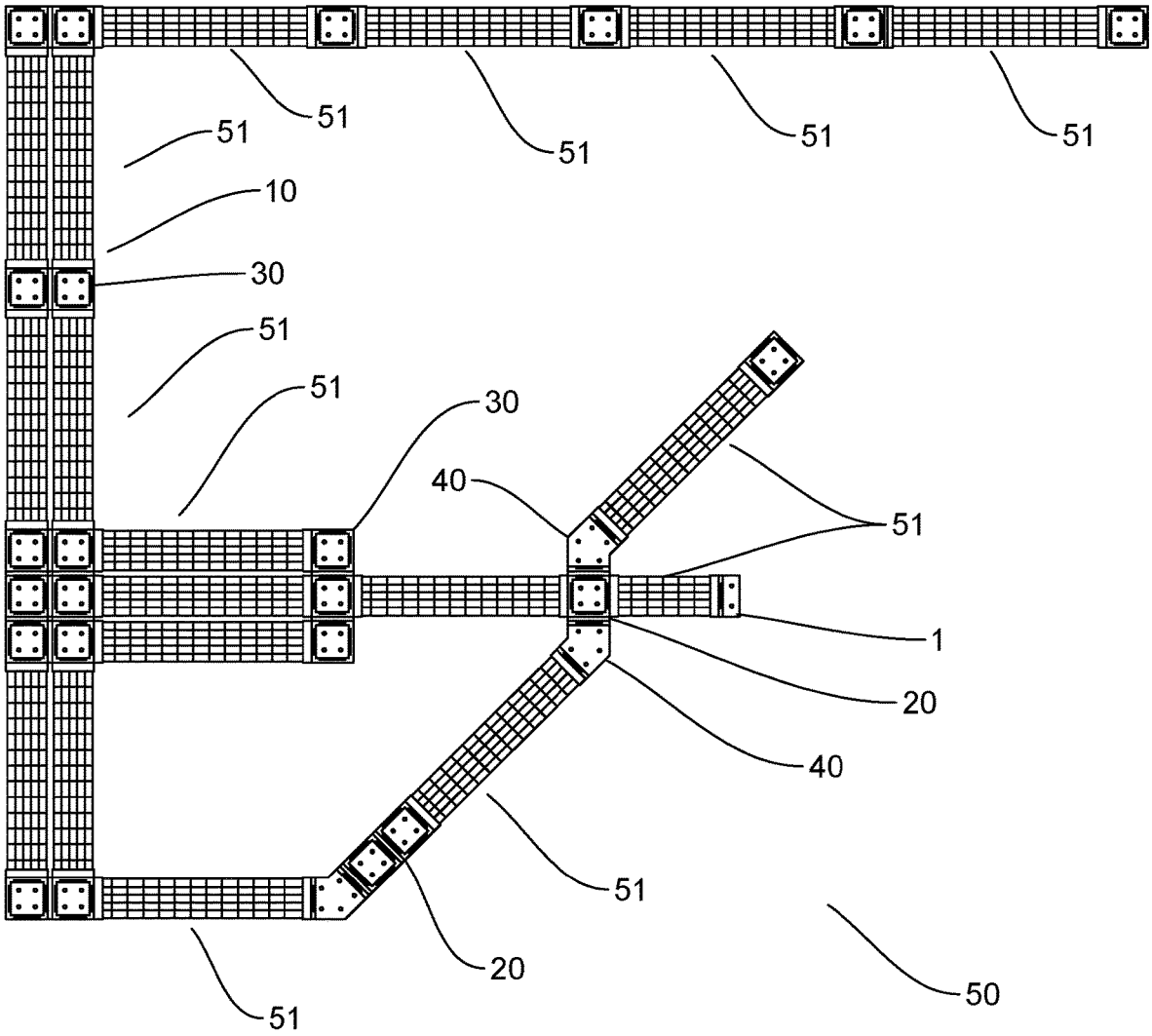
FIG. 6 depicts an embodiment of an assembled walkway according to the present disclosure.

The invention also contemplates the need to assemble walkways that are more complex than a single linear path in only one direction. To accomplish this, additional modules are included in the invention. In one case, where it is desirable to provide branches of walkway at right angles, a main block 30 provides an intersection that can receive ends from several walkway sections. As shown in FIG. 4, the main block comprises a central section 31 with anchor holes 32 to permit anchoring of the block to the ground. In addition, each of the four edges of the block includes a slot 33 into which a tab from one of the other components of the system can be engaged. Thus, it can be readily appreciated that a system of multiple walkways radiating from a common origin can be readily created. By using a number of main blocks, it will also be possible to assemble a walkway system having a grid pattern, an example of which is depicted in FIG. 6. While a square main block with four places to receive walkway sections has been shown, it is also possible to produce and use a main block with 3, or 5 or more places to dock walkway sections, allowing for the easy assembly of complex walkway designs.

Figure 5:
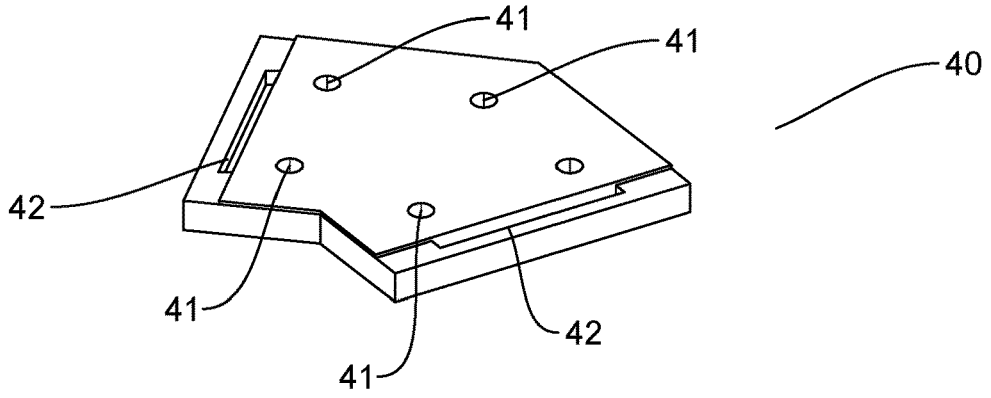
FIG. 5 depicts a perspective view of an embodiment of an angled block according to the present disclosure.
Figure 5:
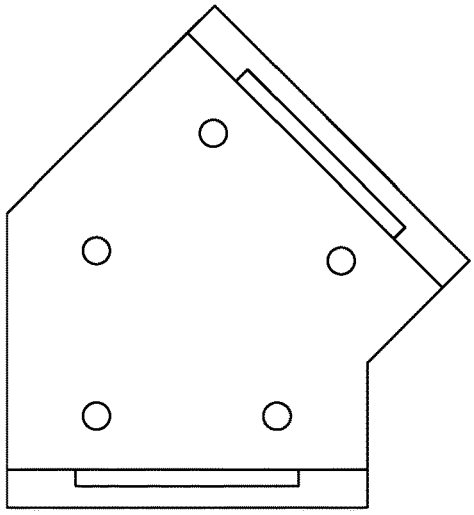

While the main block allows for creation of paths oriented at right angles to each other, at times it may desirable to extend a walkway at an angle other than 90°. As shown in FIG. 5, an angled block 40 allows, in one embodiment, the connection of two walkway sections at a 45° angle to each other. Other angles are also possible (e.g., 30°, 60°) by varying the shape of the angle block accordingly. As like the other components of the system, an angled block can comprise holes 41 for anchoring the block to the surface and one or more slots 42 for receiving tabs on other components.

Depicted in FIG. 6 is one example of a walkway system that can be assembled using the components described herein. As can be seen paths can be constructed that extend at various angles as well as right angles relative to a reference point. In addition, as can be readily seen in FIG. 6, it is possible to construct pathways of various widths, thus accommodating a wide range of applications and pieces of equipment. Each section of walkway will comprise a plurality of members 51 that will be secured by the various components of the system that have been described in FIGS. 1-5.

Figure 7:
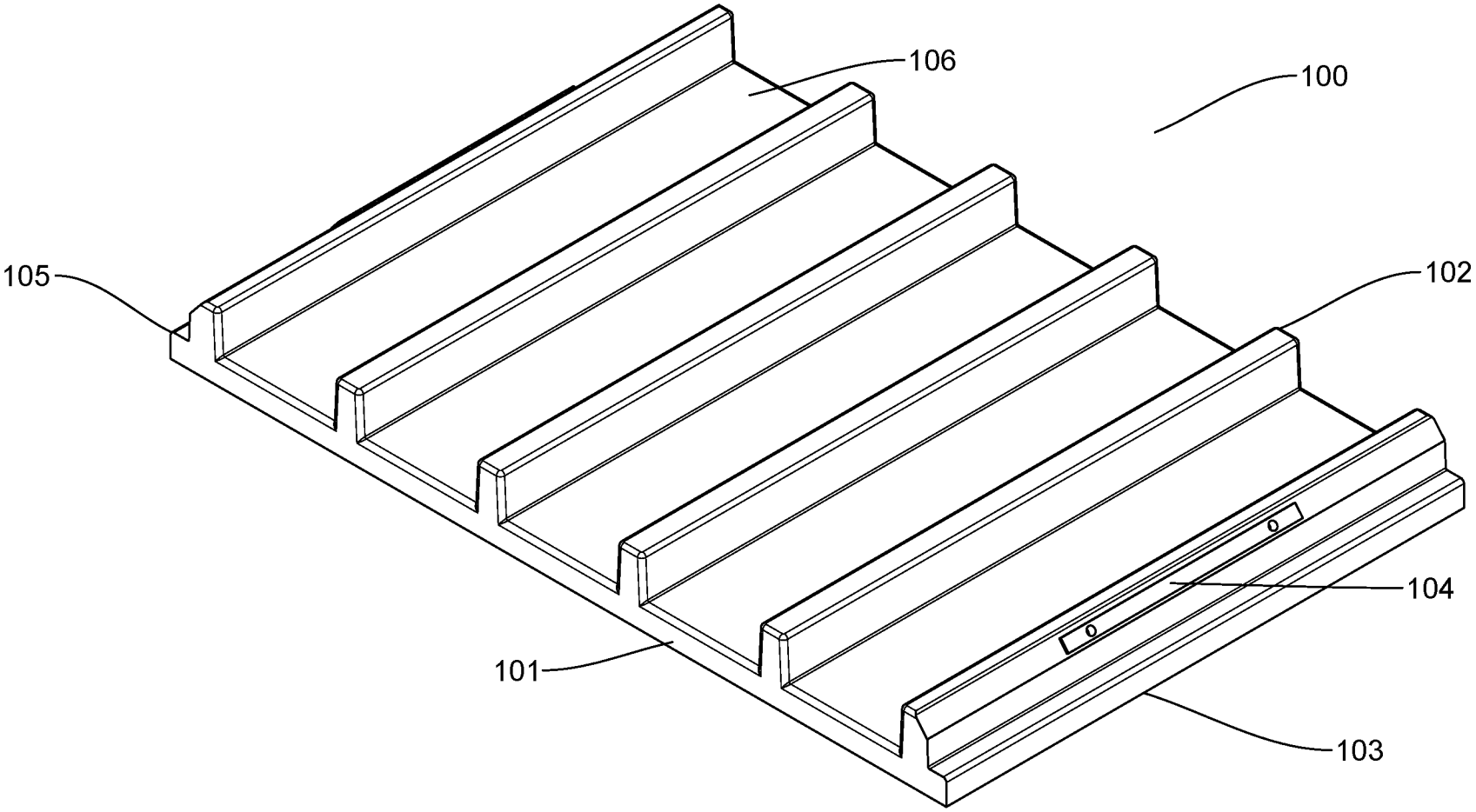
FIG. 7 depicts an perspective view of an embodiment of a mat used in assembling a walkway according to the present disclosure.

As shown in FIG. 7, in another embodiment of a system for assembling walkways, platforms and other similar structures, a base mat 100 forms the basis unit with which to build a walkway or platform. The base mat comprises a main body 101 and a plurality of ribs 102, the ribs extending from a ground surface of the main body at an approximately 90° angle. The main body can further include lateral edges 103, 105, and a location where a reflective attachment 104 can be secured. The spaces 106 between adjacent ribs can be selected to fit the size of the particular walkway member 51 to be used in assembling the walkway.

Figure 8:
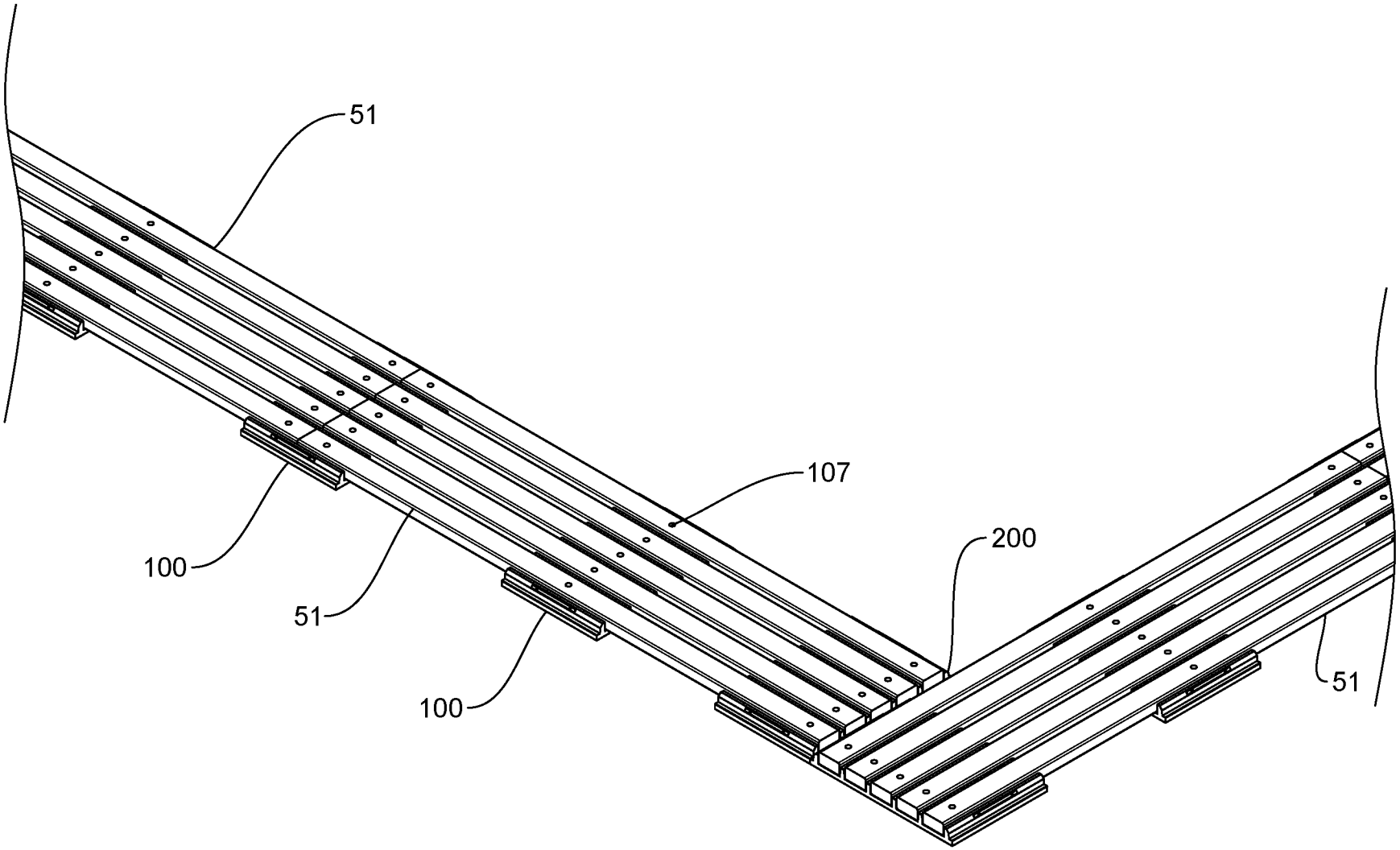
FIG. 8 depicts a perspective view of a section of a walkway according to the present disclosure, and including a 90° junction between two sections of the walkway.
Figure 9:
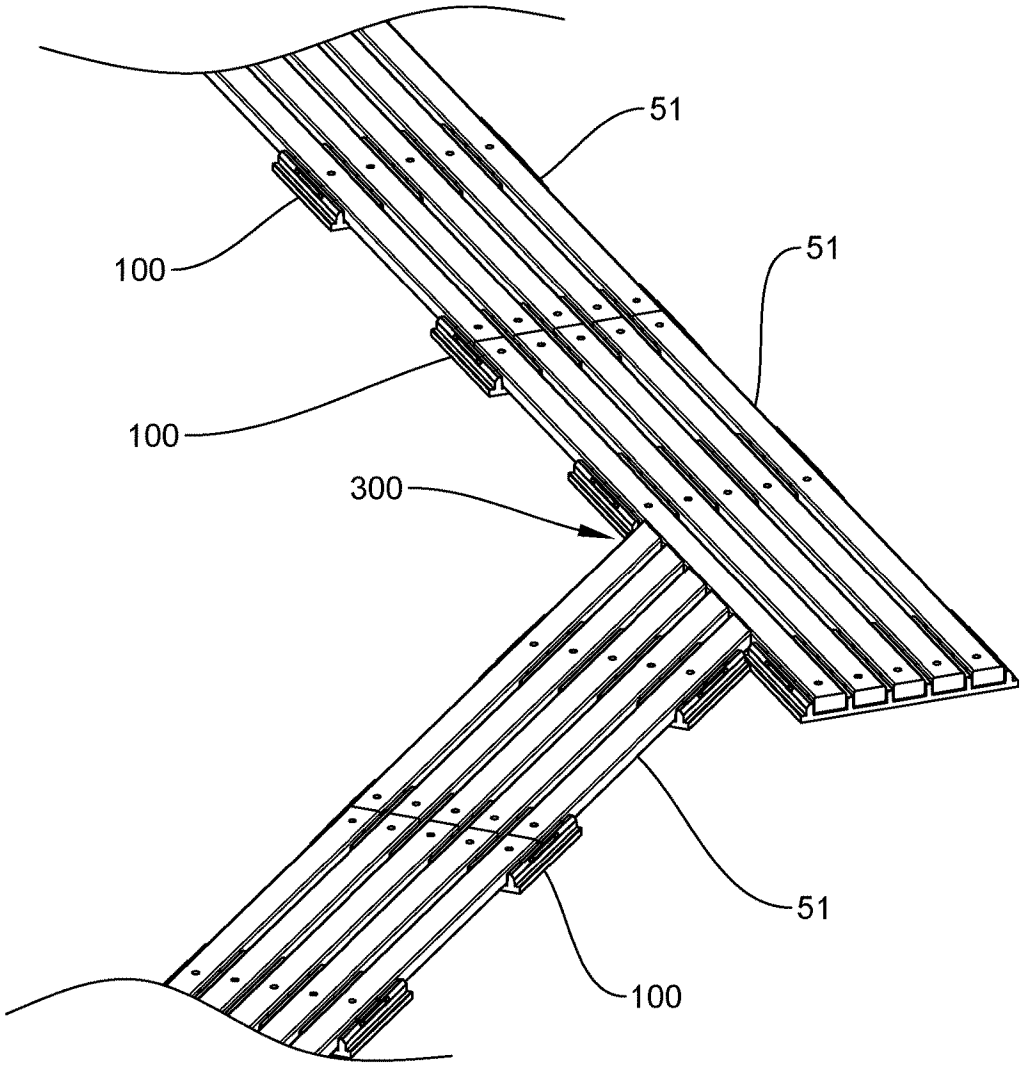
FIG. 9 depicts a perspective view of a section of a walkway according to the present disclosure, and including a 45° junction between two sections of the walkway.

As can be seen in FIG. 7, a walkway can be constructed by placing a number of base mats 100 on a surface over which one desires to assemble a walkway surface. A plurality of members 51 are then placed in the spaces 106. Spacing between mats will be dependent on the length of the members used. For additional security, members 51 can be fastened to mat with fasteners 107. Fasteners can be any of a variety of fasteners known in the art including nails, screws and the like. As also shown in FIG. 8, where a 90° junction 200 is desired, it can be formed by simply abutting two mats against each other with the mats rotated 90° relative to each other. Similarly, in order to form junctions at angles other than 90° the members can be assembled and secure to the mat, and then the members cut at the desired angle for the junction, for example a 45° junction 300 an example of which is shown in FIG. 9. In its simplest embodiment, for use in straight or 90° corner paths, a single base mat could be used with the appropriate rib configuration on the ground surface thereof, to simplify the number of different components required for modular path assembly in accordance with the method of the present invention.

Finally, the modular components of the system can be made from a variety of materials. In some embodiments, the components can be made from recycled rubber materials, heated and formed into the desired shape using well known molding processes. Walkway members as described above can be fashioned from industry standard size planks or boards that can be fashioned form wood, composites or other suitable materials.

It will be apparent to those skilled in the art that many more modifications besides those already described are possible without departing from the inventive concepts herein. For example, it will be realized that the optimal dimensions for the various parts of the invention, materials, shape, form, manner of assembly, and operation or use will be apparent to those of skill in the art. The inventive subject matter, therefore, is not to be restricted except in the scope of any claims as may be directed to the disclosure presented herein. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. All suitable modifications and equivalents that may be resorted to are thereby considered to be within the scope of the present invention.

The invention claimed is:

1. A base mat for use in a modular walkway, said base mat comprising an integrally formed body with an upward facing walkway surface and a downward facing ground surface and having a plurality of substantially parallel ribs extending upwards from the upward facing walkway surface, each rib continuing substantially the full length of the body, each rib separated from each adjacent rib by a space sized to engage a walkway member therein which can extend through linear aligned spaces between ribs on adjacent base mats to align and hold in position a modular walkway, each space substantially parallel to each other space and continuing substantially the full length of the body, and wherein the linear orientation of the ribs will define a walkway orientation of the walkway surface, and wherein the base mat comprises recycled rubber materials.

2. The base mat of claim 1 wherein the number of ribs is at least two, defining at least one space configured to engage a walkway member.

3. The base mat of claim 1, further comprising a reflective material affixed to the base mat.

4. A modular system for assembling a walkway, the system comprising a plurality of base mats and a plurality of walkway members, wherein:

a. each base mat comprises an integrally formed main body with an upward facing walkway surface and a downward facing ground surface and having a plurality of substantially parallel ribs extending upwards from the upward facing walkway surface, each rib continuing substantially the full length of the body, each rib separated from each adjacent rib by a space sized to engage a walkway member therein which can extend through linear aligned spaces between ribs on adjacent base mats to align and hold in position a modular walkway, each space substantially parallel to each other space and continuing substantially the full length of the body;

b. the base mats are attachable adjacent to each other via the walkway members being placed between the ribs through the linear aligned rib-defined spaces on the upward facing walkway surface of adjacent base mats;

c. wherein the relative orientation of the ribs defines an orientation of the walkway surface; and d. wherein the base mat comprises recycled rubber materials.

5. The system of claim 4 further comprising a plurality of fasteners, wherein each of the plurality of fasteners is configured to secure a walkway member to the base mat.

6. The system of claim 4 wherein walkway members are comprised of at least one of wood and composite material.

7. The system of claim 4 wherein each base mat comprises at least two ribs, and at least one space configured to engage a walkway member.

8. The system of claim 4 further comprising a reflective material affixed to at least one base mat.

9. The system of claim 4 further comprising a non-slip material applied to at least one walkway member.

10. A method of assembling a walkway using a modular system, the method comprising:

a. providing a plurality of base mats and a plurality of walkway members wherein each base mat comprises an integrally formed main body with an upward facing walkway surface and a downward facing ground surface and having a plurality of substantially parallel ribs extending upwards from the upward facing walkway surface, each rib continuing substantially the full length of the body, each rib separated from each adjacent rib by a space sized to engage a walkway member therein which can extend through linear aligned spaces between ribs on adjacent base mats to align and hold in position a modular walkway, each space substantially parallel to each other space and continuing substantially the full length of the body, and wherein at least one of said plurality of base mats comprises recycled rubber;

b. in a first assembly step, placing one part of a walkway member in the space between adjacent ribs of a first base mat;

c. in a second assembly step, placing part of the same walkway member in a corresponding aligned space between two adjacent ribs of at least one additional base mat;

d. in a third assembly step, securing the same walkway member to each of the first and the at least one additional base mat; and e. repeating first, second and third assembly steps until each space in the first and the at least one additional base mat is occupied by a walkway member.

11. The method of claim 10 comprising adding additional base mats and walkway members in such a way as to extend the walkway to a desired final length.

12. The method of claim 10 further comprising forming a junction in a walkway system by placing a first section of walkway and second section of walkway at an angle relative to each other.

13. The method of claim 12 wherein the angle is about 90°.

14. The method of claim 12 wherein the angle is between about 30° and 60°.

15. The method of claim 12 wherein the angle is about 45°.

16. The method of claim 10 wherein the step of securing involves the use of at least one fastener.

17. An integrally formed base mat comprising:

a body having a downward facing surface and an upward facing surface, the upward facing surface comprising a plurality of upwardly extending substantially parallel spaced-apart ribs, each of said plurality of ribs continuing substantially the full length of the body, wherein the spaced-apart ribs form recessed spaces for receiving and supporting a walkway member therein, the recessed spaces being substantially parallel to each other and continuing substantially the full length of the body, wherein the base mat comprises recycled rubber.

18. The base mat of claim 17, wherein one or both ends of the base mat are angled at an angle that is up to about 90°.

19. The base mat of claim 18, wherein the base mat is made using a molding process.

20. A walkway section comprising:

an integrally formed base mat that comprises a body having a downward facing surface and an upward facing surface, the upward facing surface comprising a plurality of upwardly extending substantially parallel spaced-apart ribs continuing substantially the full length of the body that form recessed spaces being substantially parallel to each other and continuing substantially the full length of the body, wherein said downward facing surface is substantially planar, wherein the base mat comprises recycled rubber; and a walkway member engaged within each of said recessed spaces.

21. A walkway system comprising the walkway section of claim 20.

22. The walkway section of claim 20, wherein said base mat comprises six upwardly extending substantially parallel spaced-apart ribs and five substantially parallel recessed spaces.

23. The base mat of claim 17, wherein said body comprises six upwardly extending substantially parallel spaced-apart ribs and five substantially parallel recessed spaces.

24. A recycled rubber base mat comprising:

an integrally formed body having a downward facing surface and an upward facing surface, the upward facing surface comprising upwardly extending substantially parallel spaced-apart ribs forming substantially parallel recessed spaces, each of said ribs and each of said recessed spaces continuing substantially the full length of the body, wherein each of the recessed spaces are for receiving and supporting a plank or board therein, wherein said integrally formed body comprises recycled rubber.

* * * * *